US008615187B2

(12) United States Patent
Kunihiro

(10) Patent No.: US 8,615,187 B2
(45) Date of Patent: Dec. 24, 2013

(54) DEVELOPING DEVICE AND IMAGE FORMING APPARATUS HAVING DEVELOPER CHUTE COMPOSED OF STAINLESS STEEL PLATE HAVING REGIONS WITH AUSTENITIC AND HEMMING-INDUCED MARTENSITIC PHASES

(75) Inventor: Hisashi Kunihiro, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 13/030,458

(22) Filed: Feb. 18, 2011

(65) Prior Publication Data

US 2011/0206420 A1 Aug. 25, 2011

(30) Foreign Application Priority Data

Feb. 22, 2010 (JP) ..... P2010-036582

(51) Int. Cl.
*G03G 15/09* (2006.01)

(52) U.S. Cl.
USPC ..... 399/273; 399/274; 399/283

(58) Field of Classification Search
USPC ..... 399/273, 283
See application file for complete search history.

(56) References Cited

U.S. PATENT DOCUMENTS

| | | | | |
|---|---|---|---|---|
| 4,406,536 | A * | 9/1983 | Suzuki et al. | 399/259 |
| 4,436,055 | A * | 3/1984 | Yamashita et al. | 399/269 |
| 5,583,622 | A * | 12/1996 | Nishimura | 399/274 |
| 5,758,240 | A | 5/1998 | Ito et al. | |
| 5,765,080 | A * | 6/1998 | Bogoshian | 399/275 |
| 5,978,634 | A * | 11/1999 | Sato et al. | 399/277 |
| 5,987,288 | A * | 11/1999 | Mori et al. | 399/269 |
| 6,421,517 | B1 * | 7/2002 | Nishino et al. | 399/254 |
| 7,620,351 | B2 * | 11/2009 | Onda et al. | 399/274 |
| 2007/0242986 | A1 | 10/2007 | Matsuyama et al. | |
| 2009/0226220 | A1 | 9/2009 | Kunihiro et al. | |
| 2012/0027470 | A1 * | 2/2012 | Kunihiro | 399/273 |
| 2012/0051798 | A1 * | 3/2012 | Kunihiro | 399/274 |

FOREIGN PATENT DOCUMENTS

| | | |
|---|---|---|
| JP | 9-114248 | 5/1997 |
| JP | 10-048951 | 2/1998 |
| JP | 2000-122415 | 4/2000 |
| JP | 2000-214668 | 8/2000 |
| JP | 2009-186741 | 8/2009 |

* cited by examiner

*Primary Examiner* — David Gray
*Assistant Examiner* — Geoffrey Evans
(74) *Attorney, Agent, or Firm* — Nixon & Vanderhye, P.C.

(57) ABSTRACT

A developing device and an image forming apparatus capable of suppressing occurrence of development hysteresis and moving a developer on a chute without being retained is provided. The developing device provides a chute that guides a two-component developer regulated by a regulating member in the direction separating from a developing roller. The chute is composed of a rectangular thin plate made of non-magnetic austenitic stainless alloy, and a tip part that is one end part in a short side direction thereof is provided so as to face a surface of the developing roller. The tip part is transformed to a processed induced martensitic phase to be made ferromagnetic, and subjected to magnetic field orientation in an area facing the surface of the developing roller so as to form a repulsive magnetic field.

4 Claims, 6 Drawing Sheets

DEVELOPING DEVICE AND IMAGE FORMING APPARATUS HAVING DEVELOPER CHUTE COMPOSED OF STAINLESS STEEL PLATE HAVING REGIONS WITH AUSTENITIC AND HEMMING-INDUCED MARTENSITIC PHASES

CROSS-REFERENCE TO RELATED APPLICATION

This application claims priority to Japanese Patent Application No. 2010-036582, which was filed on Feb. 22, 2010, the contents of which are incorporated herein by reference in its entirety.

BACKGROUND OF THE INVENTION

1. Field of the Invention

The present invention relates to a developing device and an image forming apparatus that use a two-component developer and employ electrophotography.

2. Description of the Related Art

An image forming process using an electrostatic photography commonly includes a charging step, an exposure step, a developing step, a transfer step, a cleaning step, a charge removing step, and a fixing step. At a step of forming an image, for example, a surface of a photoreceptor drum that is rotationally driven by a charging device is uniformly charged, and a laser beam is irradiated to the surface of the photoreceptor drum charged by an exposure device, then an electrostatic latent image is formed. Subsequently, the electrostatic latent image on the photoreceptor drum is developed by a developing device, and a toner image is formed on the surface of the photoreceptor. The toner image on the photoreceptor drum is transferred onto a transfer material by a transfer device, then heated by a fixing device, and the toner image is thereby fixed onto the transfer material. Additionally, a residual toner remained on the surface of the photoreceptor after transfer is removed by a cleaning device and collected by a predetermined collecting section, while a residual charge is removed with a charge removing device from the surface of the photoreceptor after cleaning for preparing for next image formation.

As a developer that develops the electrostatic latent image on the photoreceptor, a one-component developer composed of only a toner or a two-component developer composed of a toner and a carrier is commonly used. The one-component developer does not use the carrier, thus does not need a stirring mechanism or the like for mixing the toner and the carrier uniformly, and has an advantage such that the developing device comes to be simply configured, however, has a disadvantage such that a charging amount of a toner is hard to be stabilized, or the like. The two-component developer needs the stirring mechanism or the like for mixing the toner and the carrier uniformly, thus has a disadvantage such that a configuration of the developing device becomes complicated, however, is often used for a high-speed image forming apparatus and a color image forming apparatus because of having excellent stability of the charging amount.

As a developing device using the two-component developer, a developing device including a developer tank, a developing roller, a stirring member, a regulating member, a chute and the like is commonly used. The developer tank supports the developing roller and the stirring member so as to be rotatable as well as reserves the developer inside thereof. The developing roller bears a developer layer on the surface thereof and rotates, and supplies the toner to the electrostatic latent image on the surface of the photoreceptor to form the toner image. The stirring member stirs the developer in the developer tank uniformly to convey toward the developing roller. The regulating member regulates a layer thickness of the developer layer on a surface of the developing roller.

Further, as a developer that develops the electrostatic latent image on the photoreceptor, a one-component developer composed of the toner as a main component, or a two-component developer composed of the toner and the carrier as main components is commonly used. The one-component developer does not use the carrier, thus does not need the stirring mechanism or the like for mixing the toner and the carrier uniformly, and has an advantage such that the developing device comes to be simply configured, while having a disadvantage that the charging amount of the toner is hard to be stabilized, or the like. Therefore, the two-component developer is often commonly used for the high-speed image forming apparatus and the color image forming apparatus.

On the other hand, in the two-component developer, when a toner content rate (hereinafter, referred to as toner concentration) changes in the developer on the developing roller, image concentration of an image developed at a part where toner concentration changes, and the developing device employing the two-component developer is thus required to develop on the photoreceptor with the developer whose toner concentration is always uniform. Consequently, the developing device stirs the two-component developer (carrier and toner) sufficiently to uniform the toner concentration, and thereafter supplies the toner with the developing roller to the surface of the photoreceptor.

However, there is a problem of image defection, what is called, development hysteresis that, when the two-component developer in which the toner is consumed because of being provided for development (that is, including a part where the toner concentration changes) is provided for development again from the developing roller to the surface of the photoreceptor without separating from a surface of a developing roller sleeve, the image concentration becomes ununiform at the part where the toner concentration changes.

Such a problem is caused by a developer that has been remained on a sleeve of the developing roller after development or a toner with low charging in many cases, and there is a need to improve peeling properties of the developer on a developing sleeve or to remove the remained toner of the developing sleeve.

For example, in Japanese Unexamined Patent Publication JP-A 2000-214668, a magnet sheet is provided on an upstream side of the flow of the developer on a developer return guiding plate, and the developer is handed over the developer return guiding plate until nothing is left due to an effect of a line of magnetic force generated by the magnet sheet and a first magnet.

In the developing device described in the JP-A 2000-214668, the developer is easy to be magnetically attracted to the magnet sheet, and particularly in a device that is used by varying speed of the developing roller, it is hard to set magnetic force of the magnet sheet, and a magnetic force vector is different between an end part and a flat part of the magnet sheet, thereby posing a problem such that it is easy to progress retaining of the developer from a leaking magnetic field part to the direction of a plate thickness thereof.

SUMMARY OF THE INVENTION

An object of the present invention is to provide a developing device and an image forming apparatus that are capable of suppressing occurrence of development hysteresis, and moving a developer on a chute without stagnating.

The invention provides a developing device that develops an electrostatic latent image formed on a surface of a photoreceptor drum comprising:

a developing roller that rotates in a state where a two-component developer is borne on a surface thereof, and supplies a toner to the surface of the photoreceptor drum to develop the electrostatic latent image;

a regulating member that regulates a bearing amount of the two-component developer borne on the surface of the developing roller; and a chute that guides the two-component developer regulated by the regulating member to a direction separating from the developing roller, the chute being composed of a rectangular thin plate made of non-magnetic austenitic stainless alloy, and being provided so that one end part in a short side direction thereof faces the surface of the developing roller, the one end part in the short side direction thereof being transformed to a processed induced martensitic phase to be made ferromagnetic, and being subjected to magnetic field orientation in an area facing the surface of the developing roller so as to form a repulsive magnetic field.

According to the invention, a developing device comprises a chute that guides the two-component developer regulated by a regulating member to a direction separating from the developing roller, the chute being composed of a rectangular thin plate made of non-magnetic austenitic stainless alloy, and being provided so that one end part in a short side direction thereof faces the surface of the developing roller. The one end part in the short side direction of the chute is transformed to a processed induced martensitic phase to be made ferromagnetic, and subjected to magnetic field orientation in an area facing the surface of the developing roller so as to form a repulsive magnetic field.

Occurrence of the development hysteresis is caused by the two-component developer that remains on the developing roller even after development, and thus is able to be resolved by peeling the two-component developer after development from the developing roller.

The chute is configured as described above, and move of the two-component developer from the developing roller to the chute is thus facilitated so that it is possible to peel off the two-component developer after development from the developing roller, and it is thereby possible to suppress occurrence of the development hysteresis and move the two-component developer on the chute without being retained.

Further, in the invention, it is preferable that the chute has a plate thickness of 1.0 to 1.5 mm, and the one end part in the short side direction of the chute is subjected to hemming processing.

According to the invention, the chute has a plate thickness of 1.0 to 1.5 mm, and the one end part in the short side direction of the chute is subjected to hemming processing. Hemming is performed at an end part so that a bending part is transformed to a martensitic phase to be made ferromagnetic, and it is possible to apply any magnetic field orientation.

Further, in the invention, it is preferable that the one end part in the short side direction of the chute is provided so as to face the surface of the developing roller at a position where there is almost no magnetic binding force of the two-component developer on the developing roller, and so that a gap between the surface of the developing roller and the one end part in the short side direction of the chute falls within a range of 0.5 mm or more and 1.0 mm or less.

According to the invention, the one end part in the short side direction of the chute is provided so as to face the surface of the developing roller at a position where there is almost no magnetic binding force of the two-component developer on the developing roller, and so that a gap between the surface of the developing roller and the one end part in the short side direction of the chute falls within a range of 0.5 mm or more and 1.0 mm or less.

This makes it possible to move the two-component developer from the developing roller to the chute in an area where the developing roller faces the chute, without causing failures such as clog or aggregation of the two-component developer.

Further, in the invention, it is preferable that the chute is provided so that a main surface thereof is parallel to an applied direction of centrifugal force applied to the two-component developer with the rotation of the developing roller in a position where there is almost no magnetic binding force.

According to the invention, the chute is provided so that a main surface thereof is parallel to an applied direction of centrifugal force applied to the two-component developer with the rotation of the developing roller in a position where there is almost no magnetic binding force.

This makes it possible to effectively perform move of the two-component developer from the developing roller to the chute and move of the two-component developer on a surface of the chute.

Further, in the invention, it is preferable that at the one end part in the short side direction of the chute, magnetic field orientation is applied so that a part that is folded back through hemming and a part that overlaps the part folded back have a same magnetic pole.

According to the invention, at the one end part in the short side direction of the chute, magnetic field orientation is applied so that a part that is folded back by hemming and a part that overlaps the part folded back have a same magnetic pole.

This makes it possible to further effectively perform the move of the two-component developer from the developing roller to the chute.

Further, in the invention, it is preferable that a width in a long side direction at the one end part in the short side direction of the chute is equal to or wider than a width of an area where an electrostatic latent image of the photoreceptor drum is formed, and is equal to or narrower than a conveyance width in which the two-component developer is conveyed.

According to the invention, a width in a long side direction at the one end part in the short side direction of the chute is equal to or wider than a width of an area where an electrostatic latent image of the photoreceptor drum is formed, and is equal to or narrower than a conveyance width in which the two-component developer is conveyed.

This makes it possible to further effectively perform the move of the developing roller in both end parts in a long side direction of the chute.

Further, the invention provides an image forming apparatus comprising:

a photoreceptor on a surface of which an electrostatic latent image is to be formed;

a charging device that charges the surface of the photoreceptor;

an exposure device that forms an electrostatic latent image on the surface of the photoreceptor;

the developing device mentioned above;

a transfer device that transfers a toner image on the surface of the photoreceptor to a recording medium;

a cleaning device that cleans the surface of the photoreceptor; and a fixing device that fixes the toner image to the recording medium.

According to the invention, an electrostatic latent image on the surface of the photoreceptor drum is developed to perform image formation with the above-described developing device, and it is thus possible to perform high-quality image formation without image degradation by development hysteresis.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
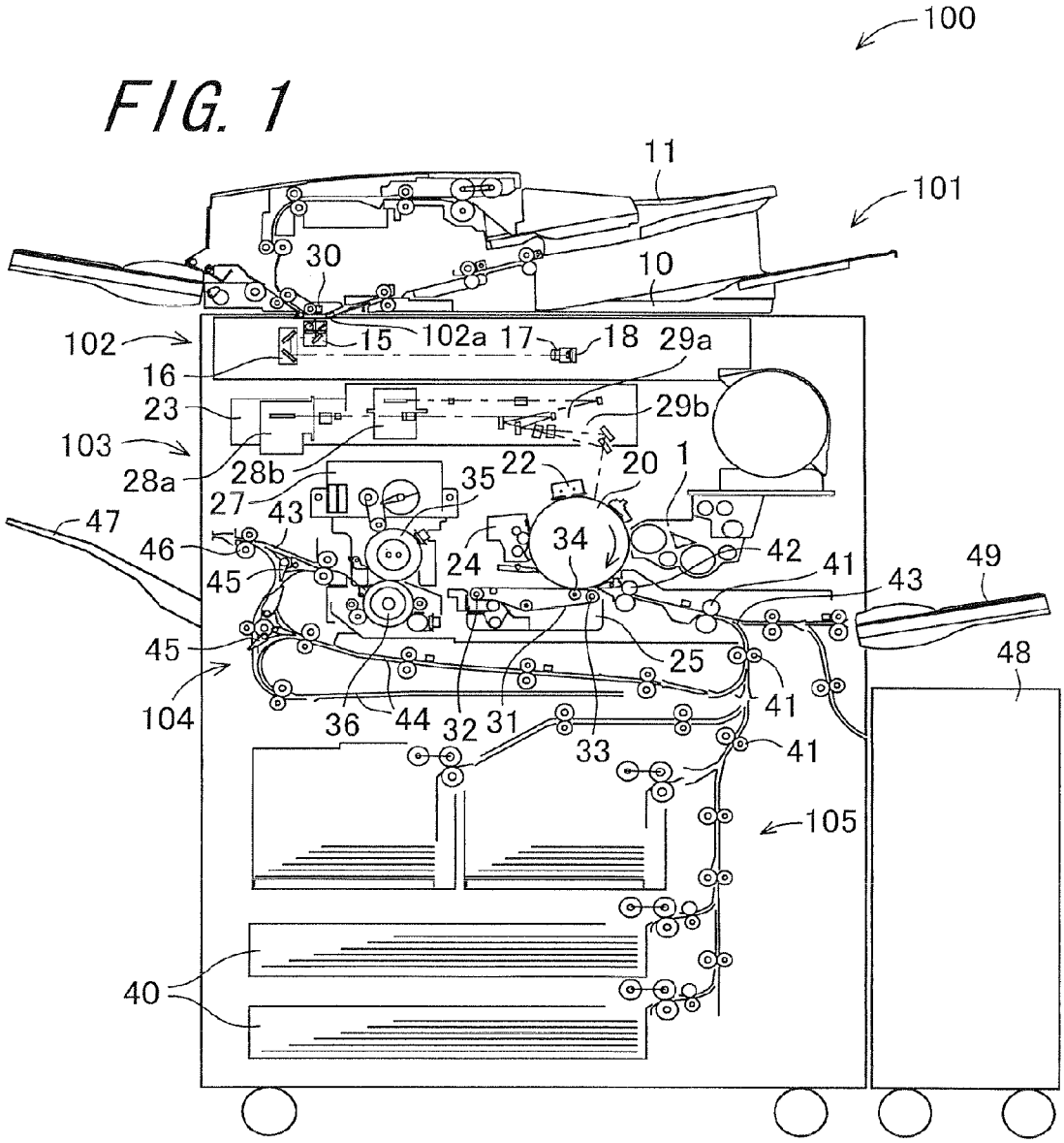
FIG. 1 is a schematic view showing an overall configuration of an image forming apparatus according to an embodiment of the invention.

Now referring to the drawings, preferred embodiments of the invention are described below.

Hereinafter, description will be given in detail for embodiments of the invention with reference to the accompanying drawings.

FIG. 1 is a schematic view showing an overall configuration of an image forming apparatus 100 according to an embodiment of the invention. The image forming apparatus 100, which obtains image data read from document paper or obtains image data received from outside to form a monochrome image shown by the image data on recording paper, comprises, by broadly dividing the configuration, an automatic document feeder (ADF) 101, an image reading section 102, a print section 103, a recording paper conveying section 104 and a paper feeding section 105.

In the automatic document feeder 101, when document paper, at least one in number, is placed on a document placement tray 11, the document paper is pulled and thereby introduced therefrom sheet by sheet into a document reading slot 102*a* of the image reading section 102, through which the document paper is conveyed to be discharged onto a catch tray 10.

Above the document reading slot 102*a*, a contact image sensor (abbreviated as CIS) 30 is disposed. This CIS 30 repeatedly reads in a main scanning direction an image formed on the back side of the document paper passing through the document reading slot 102*a*, and outputs image data of the image formed on the back side of the document paper.

Further, the image reading section 102 exposes a surface of the document paper with a lamp of a first scanning unit 15 when the document paper passes through a document reading slot 102*a*, guides reflected light from the surface of the document paper to an imaging lens 17 with mirrors of the first scanning unit 15 and a second scanning unit 16, and produces an image borne on the surface of the document paper on a CCD (Charge Coupled Device) image sensor 18 with the imaging lens 17. The CCD image sensor 18 repeatedly reads the image borne on the surface of the document paper in a main scanning direction to output image data showing the image borne on the surface of the document paper.

Furthermore, in the case where the document paper is placed on a platen glass on top of the image reading section 102, the image reading section 102 moves the first scanning unit 15 and the second scanning unit 16 with their predetermined mutual speed relationship maintained, exposes the surface of the document paper placed on the platen glass with the first scanning unit 15, guides the light reflected from the surface of the document paper to the imaging lens 17 with the first and second scanning units 15 and 16, and produces an image borne on the surface of the document paper on the CCD image sensor 18 with the imaging lens 17.

The image data to be outputted from the CIS 13 or the CCD image sensor 18 is subjected to various image processing in control circuits such as a microcomputer, before being outputted to the printing section 103.

The printing section 103, which forms images on recording paper according to image data, includes a photoreceptor drum 20, a charging device 22, an optical writing unit 23, a developing device 1, a transfer unit 25, a cleaning unit 24, and a fixing unit 27.

The photoreceptor drum 21 rotates in a single direction and has its surface cleaned by the cleaning unit 24 and then uniformly charged by the charging device 22. The charging device 22 may be a charger-type charging device or a roller-type or brush-type charging device which comes into contact with the photoreceptor drum 20.

The optical writing unit 23 is a laser scanning unit (LSU) having two laser emitting portions 28*a* and 28*b* and two mirror groups 29*a* and 29*b*. In the optical writing unit 23, laser light according to image data inputted thereto is emitted from each of the laser emitting portions 28*a* and 28*b* and this laser light is then led to the photoreceptor drum 20 by way of each of the mirror groups 29*a* and 29*b* so that the uniformly charged surface of the photoreceptor drum 20 is exposed to the laser light, thereby forming an electrostatic latent image on the surface of the photoreceptor drum 20.

To deal with the high-speed printing process, the optical writing unit 23 adopts a two beam system with the two laser emitting portions 28*a* and 28*b*, to thereby lessen a burden associated with faster irradiation timing.

Note that for the optical writing unit 23, the laser scanning unit may be replaced with an EL or LED writing head having an array of light-emitting elements.

The developing device 1 supplies the toner to the surface of the photoreceptor drum 20 to develop the electrostatic latent image, thereby forming a toner image on the surface of the photoreceptor drum 20. The transfer unit 25 transfers the toner image on the surface of the photoreceptor drum 21 to recording paper conveyed by the paper conveying section 104. The fixing unit 27 heats and pressurizes the recording paper so that the toner image thereon is fixed into place. After that, the recording paper is further conveyed by the paper conveying section 104 to a catch tray 47 where the recording paper is discharged. In addition, the cleaning unit 24 removes and collects a toner which remains on the surface of the photoreceptor drum 21 after the development and transfer operations.

Here, the transfer unit 25 includes a transfer belt 31, a driving roller 32, a driven roller 33, and an elastic conductive roller 34, and rotates the transfer belt 31 which is supported around the rollers 32 to 34 and other rollers with tension. The transfer belt 31 has a predetermined resistance value (for example, $1\times10^{9}$ to $1\times10^{13}$ Ω/cm), and conveys recording paper placed on the surface thereof. The elastic conductive roller 34 is pressed against the surface of the photoreceptor drum 20 with the transfer belt 31 interposed therebetween, and presses the recording paper on the transfer belt 31 against the surface of the photoreceptor drum 20. To the elastic conductive roller 34, an electric field of polarity opposite to an electrical charge of the toner image borne on the surface of the photoreceptor drum 20 is applied, and the toner image borne on the surface of the photoreceptor drum 20 is transferred to the recoding paper on the transfer belt 31 by the electric field of the opposite polarity. For example, when the toner image has an electrical charge of (−) polarity, the polarity of the electric field applied to the elastic conductive roller 34 is changed to (+) polarity.

The fixing unit 27 has a heat roller 35 and a pressure roller 36. Inside the heat roller 35, a heat source is provided for setting a surface of the heat roller 35 to a predetermined temperature (fixing temperature of around 160° C. to 200° C.). Further, a pressure member (not shown) is disposed on either side of the pressure roller 36 so that the pressure roller 36 comes into contact with the heat roller 35 at a predetermined pressure. The recording paper conveyed to a pressure-contact portion (referred to as a fixing nip portion) between the heat roller 35 and the pressure roller 36 is further conveyed by theses rollers 35 and 36 while an unfixed toner image on the recording paper is molten by heat and pressurized so that the toner image is fixed onto the recording paper.

The paper conveying section 104 includes plural pairs of conveying rollers 41 for conveying recording paper, a pair of registration rollers 42, a conveyance path 43, a reversal conveyance path 44, a plurality of branch pawls 45, and a pair of paper discharge rollers 46.

The recording paper is conveyed from the paper feeding section 105 to the conveyance path 43 along which the recording paper is further conveyed until a leading end of the recording paper reaches the registration rollers 42. At this time, the registration rollers 42 are temporarily halted, so that the recording paper curves with its leading end in contact with the registration rollers 42. Using elastic force of this curved recording paper, the leading end of the recording paper and the registration rollers 42 are aligned in parallel with each other. After this, the registration rollers 42 start to rotate and thereby convey the recording paper to the transfer unit 25 in the printing section 103, and the recording paper is then conveyed by the paper discharge roller 46 further to the catch tray 47.

The registration rollers 42 each start and stop rotating by engaging and disengaging a clutch arranged between the registration roller 42 and its drive shaft or by switching on and off a motor which serves as a drive source of the registration roller 42.

Moreover, in the case of recording an image on the back side of the recording paper as well, the plurality of branch pawls 45 turn to change routes of the conveyance path 43 and the reversal conveyance path 44 so that the recording paper is turned over in the reversal conveyance path 44 and conveyed therein back to the registration rollers 42 in the conveyance path 43. An image is thus recorded also on the back side of the recording paper.

Along the conveyance path 43 and the reversal conveyance path 44, sensors for detecting a position, etc. of the recording paper are provided in various positions. On the basis of the position of recording paper detected by these sensors, the conveying rollers and the registration rollers are driven under control for conveying and positioning the recording paper.

The paper feeding section 105 has a plurality of paper feeding trays 40. The paper feeding trays 40 are each used for storing recording paper and disposed in a lower part of the image forming apparatus 100. In addition, the respective paper feeding trays 40 are provided with pickup rollers or the like component for picking the recording paper up sheet by sheet, and the recording paper picked up is then delivered to the conveyance path 43 in the paper conveying section 104.

Since the image forming apparatus 100 according to the present embodiment aims for high-speed printing process, the paper feeding trays 51 each have a capacity for 500 to 1,500 sheets of standard-size recording paper.

Moreover, on a lateral surface of the image forming apparatus 100, a large capacity cassette (abbreviated as LCC) 48 is provided to store large piles of recording paper of different types, and a manual tray 49 is also provided to mainly feed nonstandard size recording paper.

The catch tray 47 is located on the other lateral surface of the image forming apparatus 100 than the lateral surface thereof on which the manual tray 49 is located. Instead of this catch tray 47, an aftertreatment (e.g. stapling or punching) device for discharged paper, or a plurality of catch trays may be disposed as an option.

Figure 2:
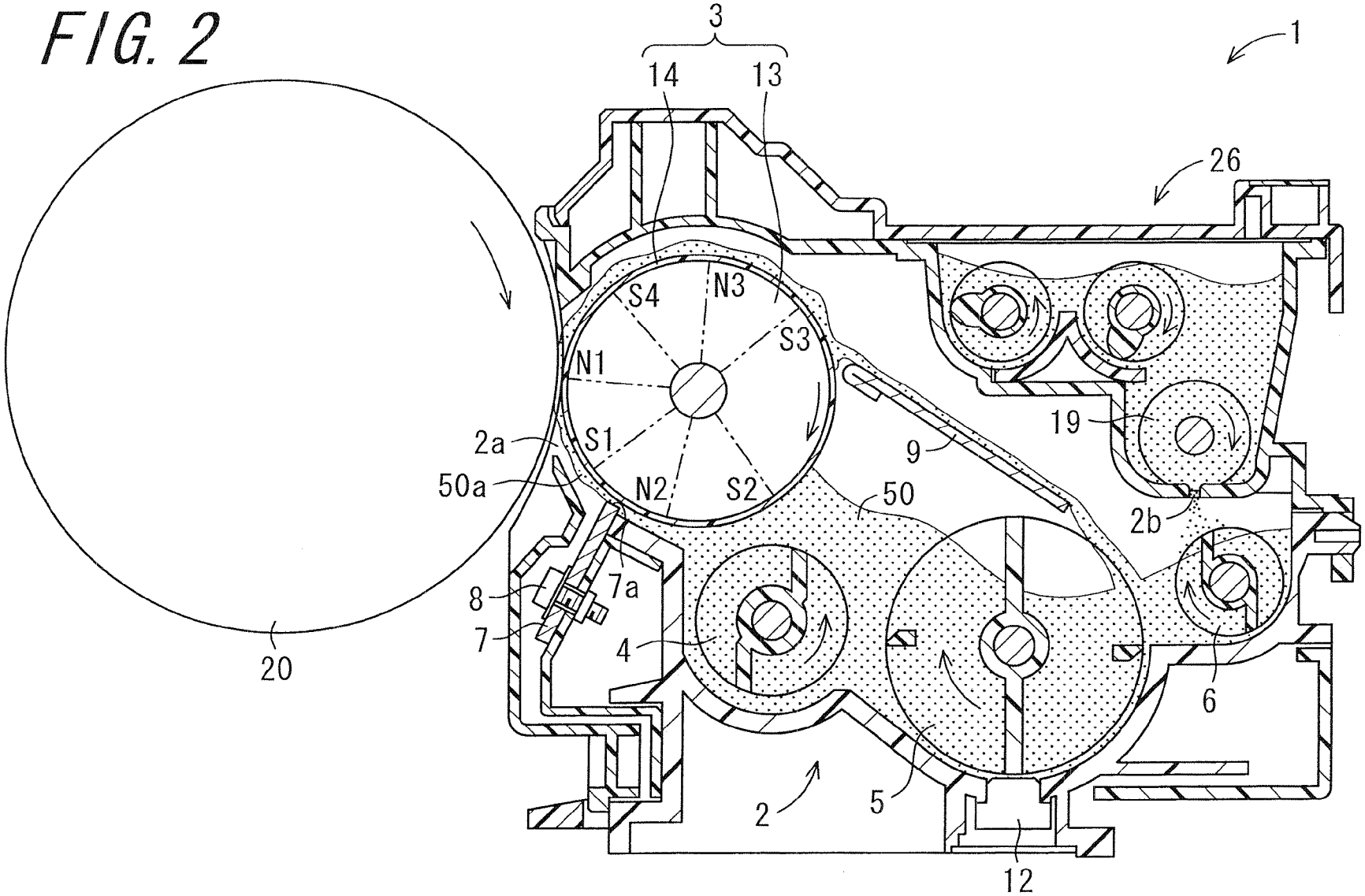
FIG. 2 is a sectional view schematically showing a configuration of a developing device according to an embodiment of the invention.

FIG. 2 is a sectional view schematically showing a configuration of a developing device 1 according to an embodiment of the invention. In FIG. 2, the developing device 1 includes a developer tank 2, a developing roller 3, a first stirring member 4, a second stirring member 5, a conveying member 6, a regulating member 7, a fixing member 8, a chute 9 and a toner concentration detecting sensor 12.

The developer tank 2 is a substantially prismatic container member having interior space, supports the developing roller 3, the first stirring member 4, the second stirring member 5 and the conveying member 6 so as to be rotatable, directly or indirectly supports the regulating member 7, the chute 9 and the like, and contains a two-component developer 50. The two-component developer 50 is a two-component developer including a toner and a carrier as magnetic material powder. Moreover, in the developer tank 2, an opening 2*a* is formed on a side surface toward the photoreceptor drum 20 when the developing device 1 is mounted on a main body of the image forming apparatus. Additionally, a toner replenishment port 2*b* is formed on an upper surface in a vertical direction of the developer tank 2.

On an upper side in the vertical direction of the developer tank 2, a toner cartridge and a toner hopper 26 are provided. More specifically, the toner cartridge, the toner hopper 26 and the developer tank 2 are provided in this order from an upper side to a lower side in the vertical direction. The toner cartridge contains a toner in interior space thereof, and is detachably provided with respect to the main body of the image forming apparatus.

Additionally, the toner cartridge is rotationally driven around an axis by a driving section (not shown) provided in the image forming apparatus. On a side surface in a long side direction of the toner cartridge, a long and thin opening extending in the long side direction is formed, and the toner falls through the long and thin opening with the rotation of the toner cartridge, and is then supplied to the toner hopper 26.

In the toner hopper 26, for example, a toner supply port as an opening formed on a bottom surface thereof in a vertical direction is provided so as to communicate in the vertical direction with the toner replenishment port 2*b* as an opening formed on an upper surface in a vertical direction of the developer tank 2. Inside the toner hopper 26, a toner replenishment roller 19 is provided on an upper side in a vertical direction of the toner supply port. The toner replenishment roller 19 is supported by the toner hopper 26 so as to be rotatable, and rotationally driven by a driving section (not shown). Rotary drive of the toner replenishment roller 19 is controlled by a control unit (not shown) provided in the image forming apparatus according to a detection result of toner concentration in the developer tank 2 by the toner concentration detecting sensor 12. The toner is replenished into the developer tank 2 by rotary drive of the toner replenishment roller 19 via the toner supply port and the toner replenishment port 2*b*.

The developing roller 3 is a roller-shaped member of which at least part is supported by the developer tank 2 so as to be rotatable, rotationally driven around the shaft center by a driving section (not shown). Moreover, the developing roller 3 faces the photoreceptor drum 20 through the opening 2*a* of the developer tank 2. The developing roller 3 is provided so as to be spaced from the photoreceptor drum 20 with a gap interposed therebetween, and the closest part is a developing nip portion. In the developing nip portion, the toner is supplied to an electrostatic latent image on the surface of the photoreceptor drum 20 from a two-component developer layer 50*a* on a surface of the developing roller 3. In the developing nip portion, developing bias voltage is applied to the developing roller 3 from a power source (not shown) connected to the developing roller 3, and move of the toner is smoothly progressed from the two-component developer layer 50*a* on the surface of the developing roller 3 to the electrostatic latent image on the surface of the photoreceptor drum 20.

The developing roller 3 includes a magnet roller 13 and a sleeve 14. The magnet roller 13 is a multipole magnetized magnetic roller whose both end parts in a long side direction are supported by a developer tank wall of the developer tank 2 and which is radially arranged in a radial direction of the developing roller 3 so that magnetic poles N1, N2, N3 and magnetic poles S1, S2, S3, S4 as a plurality of bar magnets with rectangular cross-sectional shapes are spaced from each other at circumferential positions of the developing roller 3. The magnetic pole N1, the magnetic pole S1, the magnetic pole N2, the magnetic pole S2, the magnetic pole S3, the magnetic pole N3 and the magnetic pole S4 are provided in this order, respectively, in the direction opposite to a rotation direction of the developing roller 3 (sleeve 14).

The sleeve 14 is formed with use of a nonmagnetic material. In FIG. 2, the sleeve 14 rotates in a right-handed direction (clockwise direction) toward a plane of paper, and the photoreceptor drum 20 also rotates in a right-handed direction (clockwise direction).

Both the first stirring member 4 and the second stirring member 5 are roller-shaped members supported by the developer tank 2 so as to be rotatable and provided around their axes so as to be able to be driven rotationally by a driving section (not shown). In the embodiment, the first stirring member 4 rotates in a counter-clockwise direction, and the second stirring member 5 rotates in a clockwise direction. The first stirring member 4 is provided in a position facing the photoreceptor drum 20 with the developing roller 3 interposed therebetween and on a lower side in a vertical direction of the developing roller 3. The second stirring member 5 is provided in a position facing the developing roller 3 with the first stirring member 4 interposed therebetween and on the lower side in the vertical direction of the developing roller 3. The first stirring member 4 and the second stirring member 5 stir the two-component developer 50 reserved in the developer tank 2 and impart a uniform electrical charge to the toner, as well as scoop the two-component developer 50 in a charged state to feed to a periphery of the developing roller 3.

The conveying member 6 is a roller-shaped member supported by the developer tank 2 so as to be rotatable and provided so as to be able to be driven rotationally by a driving section (not shown). The conveying member 6 faces the first stirring member 4 with the second stirring member 5 interposed therebetween, and is provided on a lower side in a vertical direction of the toner replenishment port 2*b*. The conveying member 6 conveys the toner replenished into the developer tank 2 via the toner replenishment port 2*b* to a periphery of the second stirring member 5.

The toner concentration detecting sensor 12 is, for example, mounted on a bottom surface of the developer tank 2 on a lower side in a vertical direction of the second stirring member 5, and provided so that a sensor surface is exposed inside the developer tank 2. The toner concentration detecting sensor 12 is electrically connected to the control unit (not shown). The control unit rotationally drives the toner replenishment roller 19 according to a detection result by the toner concentration detecting sensor 12, and performs control so as to replenish the toner to the inside of the developer tank 2. That is, in a case where the detection result by the toner concentration detecting sensor 12 is determined to be lower than a toner concentration setting value, a control signal is sent to the driving section that rotationally drives the toner cartridge, and rotationally drives the toner cartridge. For the toner concentration detecting sensor 12, a common toner concentration detecting sensor is able to be used, and examples thereof include a transmitted light detecting sensor, a reflected light detecting sensor, and a magnetic permeability detecting sensor. Among them, the magnetic permeability detecting sensor is preferable.

A magnetic permeability detecting sensor 12 is connected to a power source (not shown). By the power source, driving voltage for driving the magnetic permeability detecting sensor 12 and control voltage for outputting the detection result of the toner concentration to the control unit are applied to the magnetic permeability detecting sensor. Applying voltage to the magnetic permeability detecting sensor by the power source is controlled by the control unit. The magnetic permeability detecting sensor is a sensor of a type that outputs the detection result of the toner concentration as an output voltage value in response to the application of the control voltage, and is used by applying the control voltage so as to be able to obtain output voltage in the vicinity of a median value of output voltage because sensitivity near the median value of output voltage is basically favorable. Such a type of the magnetic permeability detecting sensor is commercially available, and examples thereof include TS-L, TS-A, and TS-K (all of them are trade names, manufactured by TDK Corporation).

The control unit may be provided as one for exclusive use of the developing device 1, or may be configured to be used also as a control unit provided in the image forming apparatus on which the developing device 1 is equipped. The control unit includes, for example, a storage section, a calculation section and a control section. In the storage section, detection results by various sensors, setting values, image information, table data, programs and the like are written. For the storage section, those customarily used in this relevant field may be used, and examples thereof include a read-only memory (ROM), a random-access memory (RAM), and a hard disk drive (HDD). The calculation section takes out various data input to the storage section (print command, detection result, image information, etc.) and programs for performing various control, and performs various detection and determination. The control section sends a control signal to an appropriate device according to a determination result at the calculation section, and performs operational control. The control section and the calculation section are processing circuits that are realized by, for example, a microcomputer, a microprocessor and the like provided with a CPU (Central Processing Unit). The control section includes a main power supply, together with the storage section, the calculation section and the control unit.

The regulating member 1 is a plate-like member with an approximately rectangular solid shape that extends in parallel in an axial direction (long side direction) of the developing roller 3 and has an edge section 7*a* of a tip part in a short side direction thereof, and is fixed to the developer tank 2 by the fixing member 8 on an upper side in a vertical direction of the developing roller 3 so as to provide a predetermined gap with respect to the surface of the developing roller 3.

The regulating member 7 is, for example, formed of a nonmagnetic metal having elasticity such as stainless steel or aluminum, a synthetic resin or the like. In the embodiment, thin plate-like stainless steel is used for the regulating member 7.

In the developer tank 2, the chute 9 is a plate-like member provided on a downstream side in a developer conveyance direction of the regulating member 7 in a rotational direction of the developing roller 3, and on an upper side in a vertical direction of the first stirring member 4 and the second stirring member 5. The chute 9 is provided such that a tip part of one end in a short side direction thereof faces a surface of the sleeve 14 of the developing roller 3 to be spaced from the sleeve 14 with a gap interposed therebetween, and another tip part in the short side direction thereof extends in the direction separating from the developing roller 3.

For the chute 9, a thin plate made of austenitic stainless steel (SUS300 series) as the material is used, and for the plate thickness, 1.0 to 1.5 mm is preferable. The austenitic stainless steel (SUS300 series) is basically paramagnetic, however, on a fractured surface caused by hard bending and press working, textures are changed to martensite, which makes a martensitic phase part whose textures have been changed ferromagnetic.

At a manufacturing process of the chute 9, outline trimming is performed by pressing, and the outline fractured surface changes to a martensitic phase as described above. The developer 50 conveyed in the developing device 1 with magnetic force has a possibility that poor circulation is caused since retention of the developer 50 is progressed in the event of magnetic attraction of the developer 50 onto the fractured surface of the chute 9.

Accordingly, in the invention, at the manufacturing process of the chute 9, after outline fracture by pressing, demagnetization processing is performed for the outline fractured surface except for a tip part 9*a* facing the sleeve 14 of the developing roller 3, thereafter hemming is performed.

Figure 3:
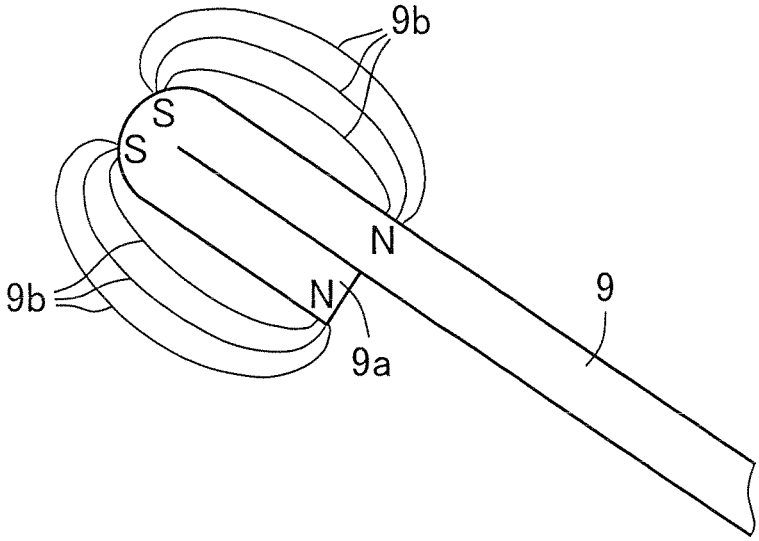
FIG. 3 is an enlarged view of a tip part.

After the demagnetization processing is performed for the outline fractured surface of the chute 9, magnetizing processing is performed by a magnetizer for the tip part 9*a* subjected to the hemming processing. As shown in an enlarged view of the tip part 9*a* in FIG. 3, a bending part of the tip part 9*a*, that is, a closest part to the sleeve 14, is magnetized to an S pole, and the vicinity of the fractured surface folded back is magnetized to an N pole. Lines of magnetic force 9*b* at the time of performing the magnetizing processing in this manner are also shown in FIG. 3. For magnetic force of each magnetic pole, both the N pole and the S pole are set to approximately 10 to 20 mT.

Figure 4:
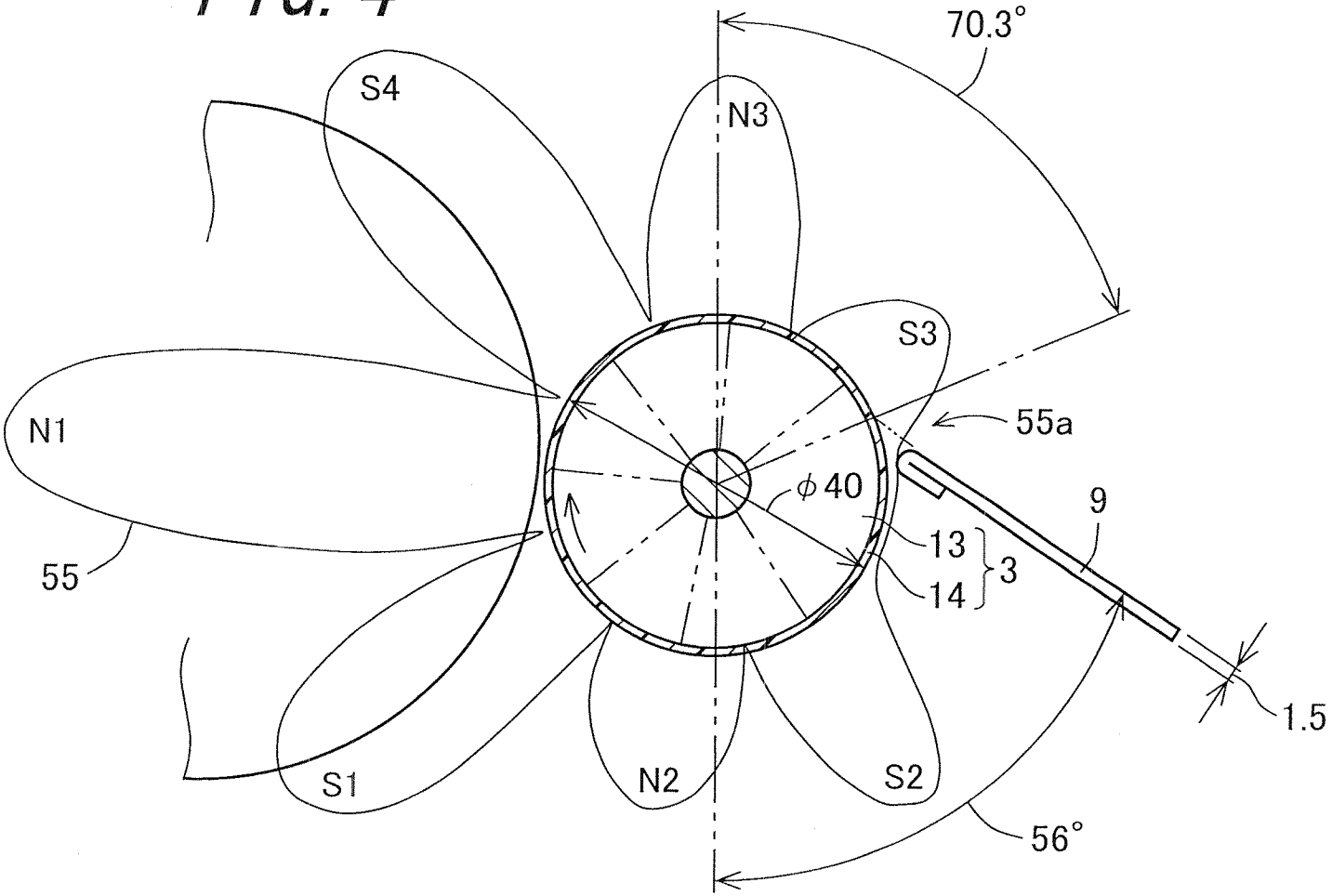
FIG. 4 is an enlarged sectional view of the proximity of a developing roller.

FIG. 4 is an enlarged sectional view of the proximity of the developing roller 3. A magnetic pattern 55 of the developing roller 3 is a pattern that occurs by radially arranging each magnet of the magnet roller 13, and indicates as an absolute value the strength of magnetic attraction force to a sleeve center direction of each magnetic pole on the surface of the sleeve 14.

With magnetic balance of the magnetic pattern 55, the developer 50 is attracted onto the sleeve 14 by the magnetic pole S2, and the sleeve 14 rotates in a right-handed direction (clockwise direction) toward a plane of paper, so that it is configured that the developer 50 is conveyed to the magnetic pole S3. Additionally, a repulsive magnetic field is generated between the magnetic pole S3 and the magnetic pole S2 to have almost no attraction force of the developer 50 on the sleeve 14, then the sleeve 14 rotates, so that the developer 50 becomes a state where it is easy to be peeled off from the sleeve 14 by centrifugal force that occurs. In order to guide the developer 50 to the chute 9 without applying stress as much as possible, it is desirable that the tip part 9*a* of the chute 9 is caused to face a position 55*a* where magnetic binding force to the sleeve 14 by the magnetic pole S3 is approximately zero, and a slope face is formed in a tangential direction to which centrifugal force at the position 55*a* directs, and a positional relationship shown in FIG. 4 is provided in the embodiment. It is preferred that a gap between the tip part 9*a* and the sleeve 14 is provided so as to fall within a range of 0.5 mm or more and 1.0 mm or less.

Figure 5:
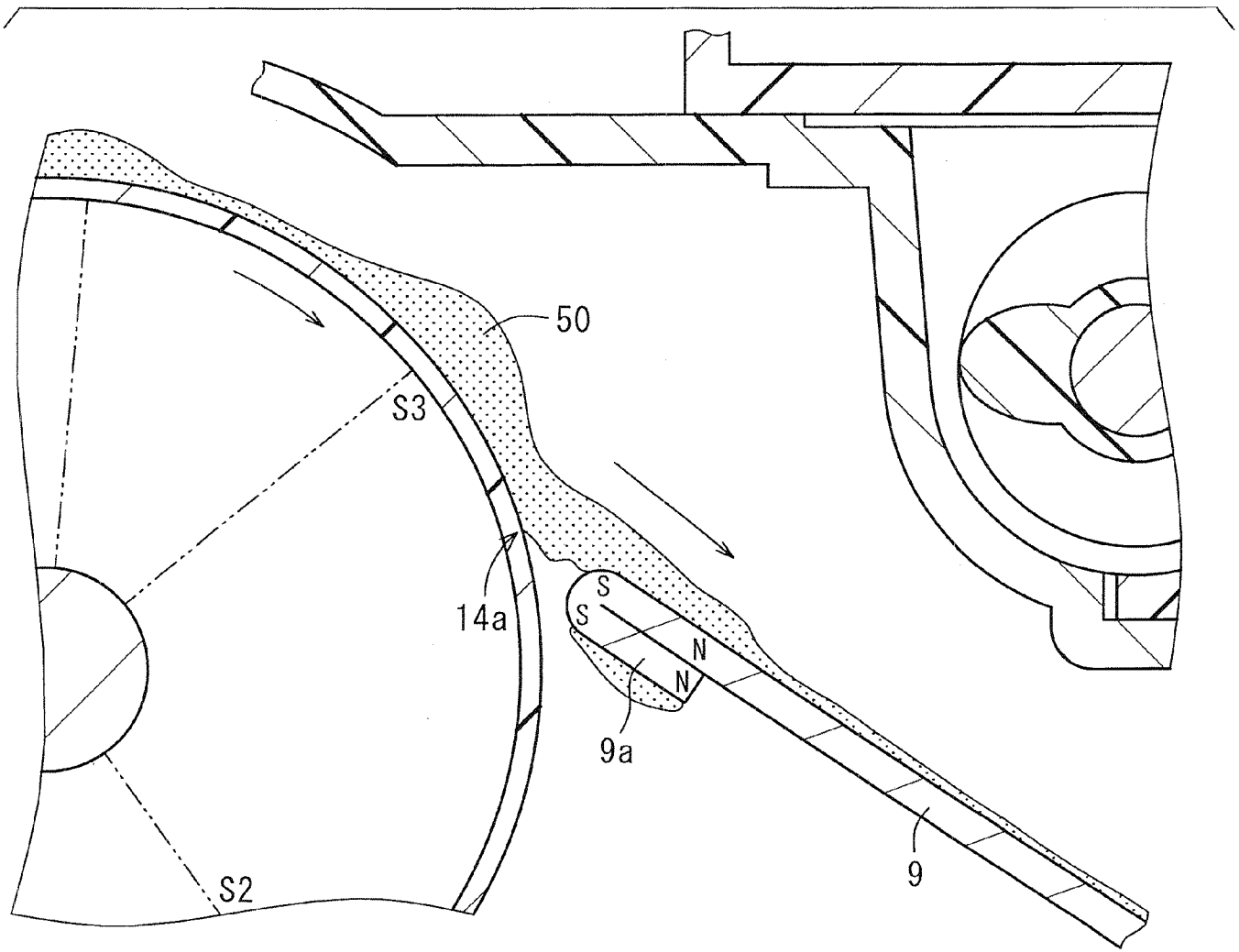
FIG. 5 is an enlarged sectional view of the proximity of the tip part of a chute.

FIG. 5 is an enlarged sectional view of the proximity of the tip part 9*a* of the chute 9. A part where the tip part 9*a* comes into closest contact with the sleeve 14 is configured so as to be magnetized to the S pole, and arranged so as to face a downstream side of the magnetic pole S3. The developer 50 scooped by the sleeve 14 moves with the rotation of the sleeve 14 and passes through a position of the magnetic pole S3, and thereafter magnetic attraction force applied in the direction toward the sleeve 14, that is, developer retention force on the surface of the sleeve 14, gradually diminishes. Further, the tip part 9*a* of the chute 9 comes to have a repulsive magnetic field against the sleeve 14, thus the developer 50 moves sequentially onto the chute 9 before entering into a narrowest part that is a position where the tip part 9*a* comes into closest contact with the surface of the sleeve 14. To the developer 50 that has moved, binding force is applied on a surface of the chute 9 by a line of magnetic force of the chute 9 between the S pole and the N pole. However, the magnetic binding force is very weak force, and conveyance itself of the developer 50 that flows is not blocked. The binding force retards moving speed of the developer 50 that moves on the surface of the chute 9 compared to moving speed of the developer 50 that moves from the sleeve 14 to the chute 9, and at a position 14*a* where the developer 50 starts moving from the surface of the sleeve 14 to the chute 9, the developer 50 slips on the sleeve 14, and the developer layer 50*a* at the position 14*a* is scraped by the developer 50 with a bridge shape that bridges between the surface of the sleeve 14 and the chute 9 so that it is possible to prevent image defection of development hysteresis or the like.

Figure 6:
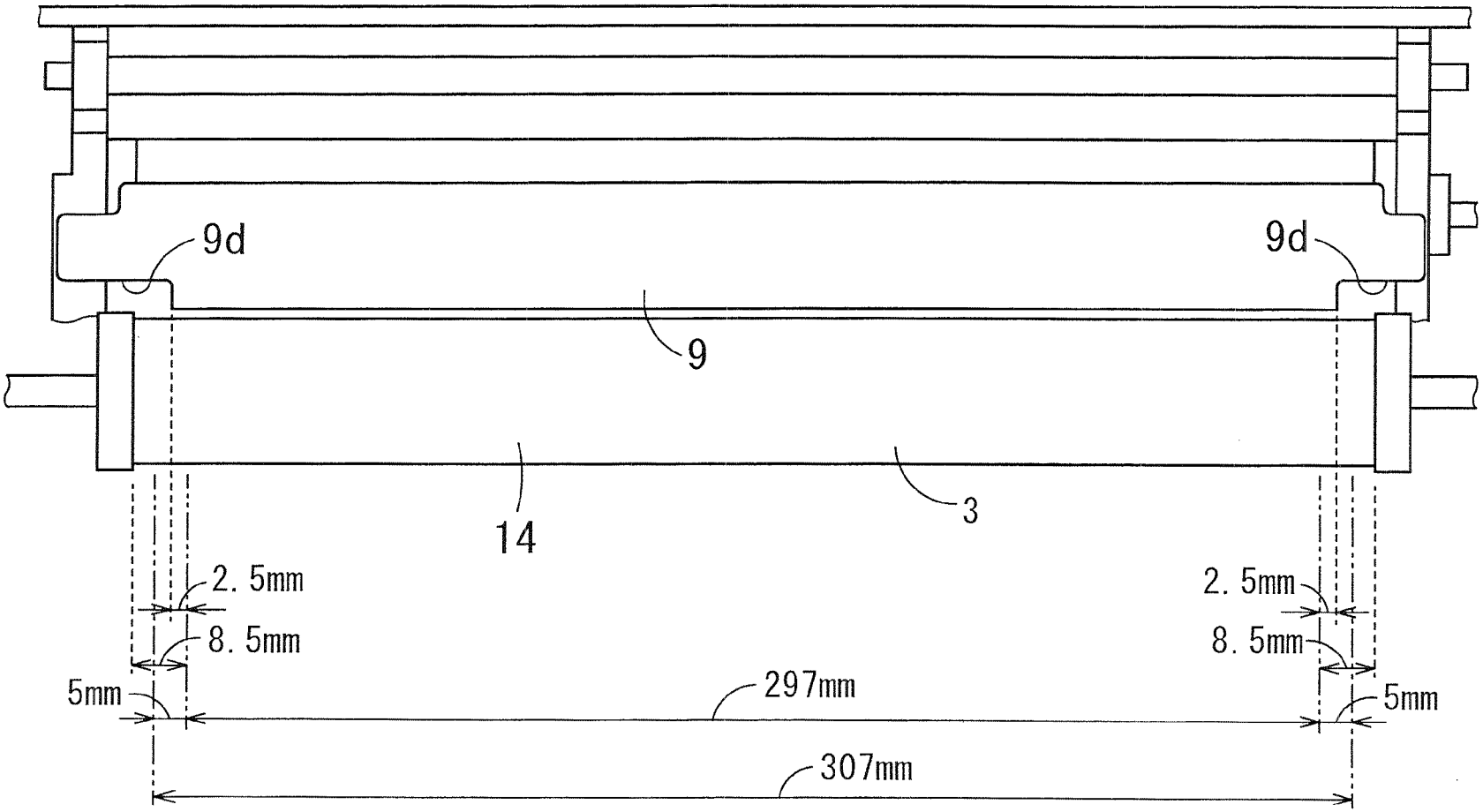
FIG. 6 is a sectional view of the developing device cut away at a plane including a rotational axis of the developing roller.

FIG. 6 is a sectional view of the developing device 1 cut away at a plane including a rotational axis of the developing roller 3. At both end parts in a long side direction at the tip part 9*a* of the chute 9, cut-out sections 9*d* are provided for supplying, as a conveyance path of the developer 50, directly to the stirring section of the developing device without moving on the surface of the chute 9. Since, as compared to magnetization of the tip part 9*a* subjected to hemming, the both end parts to which radial magnetic force with respect to the outline fractured surface is easily applied has a different state from a magnetized state of the entire end part of the chute 9 in a long side direction, retention of the developer occurs. The cut-out section 9*d* is provided inside a developer conveyance width of the sleeve 14 so that it is possible to prevent retention (adherence) of the developer from an end face in a long side direction. In the embodiment, an end part in a long side direction at the tip part 9*a* subjected to hemming is provided at a position that is located 2.5 mm inward from a sheet width (297 mm), and a conveyance width (307 mm) is set so that the developer is conveyed to a position that is located 2.5 mm outward from the sheet width.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device that develops an electrostatic latent image formed on a surface of a photoreceptor drum comprising:

a developing roller that rotates in a state where a two-component developer is borne on a surface thereof, and supplies a toner to the surface of the photoreceptor drum to develop the electrostatic latent image;

a regulating member that regulates a bearing amount of the two-component developer borne on the surface of the developing roller; and a chute that guides the two-component developer regulated by the regulating member to a direction separating from the developing roller, the chute being composed of a rectangular thin plate made of non-magnetic austenitic stainless alloy, and being provided so that one end part in a short side direction thereof faces the surface of the developing roller, the one end part being transformed to a process induced martensitic phase to be made ferromagnetic, and being subjected to magnetic field orientation in an area facing the surface of the developing roller so that a repulsive magnetic field is formed, and so that a part that is folded back through hemming and a part that overlaps the part folded back have a same magnetic pole.

2. The developing device of claim 1, wherein the one end part in the short side direction of the chute is provided so as to face the surface of the developing roller at a position where there is almost no magnetic binding force of the two-component developer on the developing roller, and so that a gap between the surface of the developing roller and the one end part in the short side direction of the chute falls within a range of 0.5 mm or more and 1.0 mm or less.

3. The developing device of claim 1, wherein a width in a long side direction at the one end part in the short side direction of the chute is equal to or wider than a width of an area where an electrostatic latent image of the photoreceptor drum is formed, and is equal to or narrower than a conveyance width in which the two-component developer is conveyed.

4. An image forming apparatus comprising:

a photoreceptor on a surface of which an electrostatic latent image is to be formed;

a charging device that charges the surface of the photoreceptor;

an exposure device that forms an electrostatic latent image on the surface of the photoreceptor;

the developing device of claim 1;

a transfer device that transfers a toner image on the surface of the photoreceptor to a recording medium;

a cleaning device that cleans the surface of the photoreceptor; and a fixing device that fixes the toner image to the recording medium.

* * * * *